US010028873B2

(12) United States Patent
Eskridge, III et al.

(10) Patent No.: US 10,028,873 B2
(45) Date of Patent: Jul. 24, 2018

(54) ADJUSTABLE BED FOUNDATION WITH ROTATING HEAD SECTION

(71) Applicant: Tempur-Pedic Management, LLC, Lexington, KY (US)

(72) Inventors: Horace R. Eskridge, III, Paris, KY (US); Paul E. Griese, Versailles, KY (US); Leslie A. Burton, Lexington, KY (US); Mario A. G. Nava, Owensboro, KY (US)

(73) Assignee: Tempur-Pedic Management, LLC, Lexington, KY (US)

( * ) Notice: Subject to any disclaimer, the term of this patent is extended or adjusted under 35 U.S.C. 154(b) by 562 days.

(21) Appl. No.: 14/694,383

(22) Filed: Apr. 23, 2015

(65) Prior Publication Data

US 2016/0206486 A1 Jul. 21, 2016

Related U.S. Application Data

(60) Provisional application No. 62/105,849, filed on Jan. 21, 2015.

(51) Int. Cl.

| | |
|---|---|
| ***A61G 7/015*** | (2006.01) |
| ***A47C 20/04*** | (2006.01) |
| ***A47C 21/02*** | (2006.01) |
| ***A61G 7/05*** | (2006.01) |
| *A61G 7/002* | (2006.01) |

(52) U.S. Cl.

CPC ..... *A61G 7/015* (2013.01); *A47C 20/041* (2013.01); *A47C 21/028* (2013.01); *A61G 7/0506* (2013.01); *A47C 21/026* (2013.01); *A61G 7/002* (2013.01); *A61G 7/051* (2016.11)

(58) Field of Classification Search

CPC ..... A61G 7/002; A61G 7/005; A61G 7/008; A61G 7/012; A61G 7/015; A61G 7/018; A61G 13/02; A61G 13/04; A61G 13/06; A61G 13/08; A47C 21/026; A47C 19/005; A47C 19/021; A47C 19/025; A47C 19/04; A47C 19/045; A47C 20/041

USPC ..... 5/617, 613, 616, 618, 600, 411, 193

See application file for complete search history.

(56) References Cited

U.S. PATENT DOCUMENTS

| | | | | | |
|---|---|---|---|---|---|
| 2,147,538 | A * | 2/1939 | Maguire et al. | A47C 21/026 | 5/411 |
| 4,458,371 | A * | 7/1984 | Whitehead | A47C 19/025 | 5/193 |
| 5,170,522 | A * | 12/1992 | Walker | A47C 20/048 | 5/615 |

(Continued)

*Primary Examiner* — Robert G Santos

(74) *Attorney, Agent, or Firm* — Middleton Reutlinger

(57) ABSTRACT

An adjustable bed foundation comprises an outer support structure including a head rail, a foot rail, and two parallel side rails. A first pair of cross members extends perpendicularly between the parallel side rails, while a second pair of cross members extends perpendicularly between the first pair of cross members. An articulating frame, which includes a stationary section and a rotating head section pivotally connected to the stationary section, is secured to the second pair of cross members such that the rotating head section extends towards the head rail. The adjustable bed foundation also includes a platform secured to the articulating frame. Adjustable bed assemblies are further provided and include a mattress positioned atop the platform of the adjustable bed foundation.

18 Claims, 4 Drawing Sheets

(56) References Cited

U.S. PATENT DOCUMENTS 5,568,661 A * 10/1996 Bathrick ..... A47C 20/041 5/285
5,608,932 A * 3/1997 Hasegawa ..... A47C 20/041 5/600
6,679,555 B2 * 1/2004 Bangert ..... A47C 20/041 297/316
6,684,423 B2 * 2/2004 Godette ..... A47C 21/006 5/600
7,039,970 B1 * 5/2006 Long ..... A47C 21/006 5/600
7,322,058 B2 * 1/2008 Long ..... A47C 21/006 5/600
7,607,181 B1 * 10/2009 Harrison ..... A47C 21/026 5/411
7,712,168 B2 * 5/2010 Kim ..... A61G 7/001 5/185
7,845,034 B2 * 12/2010 Kim ..... A61G 7/015 5/608
7,900,302 B2 * 3/2011 Long ..... A47C 20/041 5/617
8,185,986 B2 * 5/2012 Grimes ..... A61H 1/005 5/600
8,646,130 B2 * 2/2014 Alzoubi ..... A47C 20/04 5/193
8,769,739 B1 * 7/2014 McCarty ..... A47C 21/026 5/193
8,776,294 B1 * 7/2014 McCarty ..... A47C 21/026 5/193
9,795,223 B1 * 10/2017 Shih ..... A47C 19/021
9,872,806 B2 * 1/2018 Lo ..... A61G 7/015
2002/0036421 A1 * 3/2002 Bangert ..... A47C 20/041 297/316
2002/0078503 A1 * 6/2002 Godette ..... A47C 21/006 5/600
2006/0230529 A1 * 10/2006 Long ..... A47C 21/006 5/109
2009/0077744 A1 * 3/2009 Kim ..... A61G 7/001 5/202
2009/0077747 A1 * 3/2009 Kim ..... A61G 7/015 5/607
2009/0094748 A1 * 4/2009 Long ..... A47C 20/041 5/613
2011/0010860 A1 * 1/2011 Grimes ..... A61H 1/005 5/616
2012/0017373 A1 * 1/2012 Alzoubi ..... A47C 20/04 5/613
2015/0313369 A1 * 11/2015 Tarplee ..... A61H 23/0254 601/57
2016/0174724 A1 * 6/2016 Eskridge, III ..... A47C 21/026 5/613
2016/0206486 A1 * 7/2016 Eskridge, III ..... A61G 7/015
2017/0280882 A1 * 10/2017 Shih ..... A47C 20/041
2018/0008049 A1 * 1/2018 Shih ..... A47C 20/041

* cited by examiner

ADJUSTABLE BED FOUNDATION WITH ROTATING HEAD SECTION

This application claims the benefit of U.S. Provisional App. Ser. No. 62/105,849 filed Jan. 21, 2015, the entire disclosure of which is incorporated herein by reference.

TECHNICAL FIELD

The present invention relates to an adjustable bed foundation. In particular, the present invention relates to an adjustable bed foundation that makes use of an articulating frame including a head section and stationary section, where the stationary section is secured to one or more cross members to reduce deflection of and damage to the adjustable bed foundation upon rotating the head section upward.

BACKGROUND

Bed assemblies that make use of adjustable foundations are becoming increasingly popular as an alternative to traditional bed assemblies. Unlike traditional bed assemblies that make use of rigid box springs or other similar bases, a bed assembly that makes use of an adjustable foundation can readily be adjusted by articulating the foundation into a desired ergonomic position. In other words, by articulating the adjustable foundation, a user can readily change the position of the mattress lying on the adjustable foundation and, consequently, can quickly match the position of the mattress to their specific preferences and, at least partially, individualize his or her level of sleep comfort.

Despite the readily adjustable nature of such bed assemblies, the use of adjustable bed foundations can frequently lead to a number of issues. In particular, in a conventional, adjustable foundation arrangement, an articulating metal frame is commonly attached directly to the side rails of the adjustable bed foundation. Upon articulating such a metal frame, however, the side rails of the adjustable bed foundation often undergo an amount of deflection and bowing that is caused by the weight of the mattress and any users positioned on the mattress, and that, in turn, can lead to damage to the side rails of the adjustable bed foundation.

Furthermore, in such adjustable bed foundations, the articulating metal frames are frequently secured to the remainder of the adjustable bed foundation using screws that are driven vertically through the metal frame and into the top of the adjustable bed foundation. However, when the metal frame is articulated, the vertical placement of the screws, alone or in connection with the loosening of the vertical screws over a time period, allows the metal frame to move relative to the remainder of the adjustable foundation. Such movement then results in significant noise issues that reduce the enjoyment and appeal provided by the adjustable bed foundations to users.

SUMMARY

The present invention includes an adjustable bed foundation. In particular, the present invention includes an adjustable bed foundation that makes use of an articulating frame including a head section and stationary section, where the stationary section is secured to one or more cross members to reduce deflection of and damage to the adjustable bed foundation upon rotating the head section upward.

In one exemplary embodiment of the present invention, an adjustable bed foundation is provided that includes an outer support structure having a head rail, a foot rail, a first side rail, and a second side rail. In the exemplary adjustable bed foundation, the foot rail is spaced apart and parallel to the head rail. The first side rail then extends from the head rail to the foot rail, and the second side rail extends from the head rail to the foot rail in a direction parallel to the first side rail, such that, upon the joining together of the rails via corner brackets, the head rail, the foot rail, the first side rail, and the second side rail collectively define both a perimeter and an interior cavity of the outer support structure. One or more legs can then be optionally positioned below and secured to the outer support structure to support and raise the outer support structure and, consequently, the entire adjustable bed foundation.

Further included in the exemplary adjustable bed foundation is a first pair of cross members that extends perpendicularly from the first side rail to the second side rail across the interior cavity of the outer support structure. Each one of the first pair of cross members is spaced apart from the other cross member, such that the first pair of cross members divides the interior cavity into three separate cavities, namely an upper cavity, a central cavity, and a lower cavity. The adjustable bed foundation also includes a second pair of cross members that extend perpendicularly between the first pair of cross members and across the central cavity, which is defined by the first pair of cross members as well as the portions of the first side rail and the second side rail falling between the first pair of cross members. Similar to the first pair of cross members, each one of the second pair of cross members are spaced apart from the other cross member. However, each one of the second pair of cross members is also spaced apart from and in a direction parallel to the first side rail and the second side rail of the outer support structure.

In addition to the first and second pairs of cross members, the exemplary adjustable bed foundation also includes an articulating frame having a stationary section and a head section pivotally connected to the stationary section. The stationary section is secured to each one of the second pair of cross members by gap brackets, while the head section extends from the stationary section and is housed within the upper cavity. A platform for supporting a mattress is additionally included in the exemplary adjustable bed foundation, and generally includes a top portion that is secured to the head section of the articulating frame and is positioned over the upper cavity, and a bottom portion that is positioned over the central cavity and the lower cavity of the adjustable bed foundation. The platform also typically defines one or more vent holes that extend through the platform to provide ventilation to a mattress lying atop the platform.

To upwardly rotate the head section of the articulating frame and articulate the adjustable bed foundation, the adjustable bed foundation additionally includes an actuator assembly that is operably connected to the articulating frame. The actuator assembly comprises a motor that is secured to the stationary section of the articulating frame, and a reciprocating arm that is operably connected to both the motor and to the head section of the articulating frame. In this regard, in operation and upon activation of the motor via a controller and power supply operably connected to the actuator assembly, the motor causes the reciprocating arm to move backward or forward and, consequently, raise or lower the head section of the articulating frame.

With further regard to the adjustable bed foundation of the present invention, in some embodiments, the adjustable bed foundation further includes one or more additional features to increase the performance and/or the functionality of the adjustable bed foundation. For instance, in certain embodiments, a retainer bar assembly is included in an exemplary adjustable bed foundation. The retainer bar assembly is positioned adjacent to the foot rail and is configured to secure a mattress on the adjustable foundation. In some embodiments, however, in addition to securing mattress on a foundation, the retainer bar assembly is also configured to allow the retainer bar of the retainer bar assembly to be moved upward and rotated away from, the adjustable bed foundation, such that a mattress lying on the adjustable bed foundation can then be easily manipulated, (e.g., to change the sheets covering the mattress). For instance, in some embodiments, the retainer bar assembly included in the exemplary adjustable bed foundation includes a retainer bar having a horizontal rod and two legs connected to the horizontal rod, with each of the two legs having an end portion that extends from the legs in a direction substantially parallel to the horizontal rod. To secure the retainer bar to the adjustable bed foundation, the retainer bar assembly further includes a pair of brackets that each generally defines at least one channel configured to receive an end portion of one of the two legs. Unlike the rigidly-attached retainer bar assemblies traditionally used with adjustable bases, however, each channel of the brackets of the retainer bar assemblies includes a vertical segment and an angled segment, such that each channel is configured to allow the horizontal rod to be moved (e.g., pulled) upward and then rotated away from each bracket to allow easier manipulation of a mattress positioned on the adjustable bed foundation.

To secure the retainer bar assembly to an exemplary adjustable bed foundation of the present invention, in some embodiments, the adjustable bed foundation further includes a third pair of cross members that are spaced apart from one another and that extend perpendicularly from the foot rail to the cross member of the first pair of cross members that is in closest proximity to the foot rail. By extending the third pair of cross members from the foot rail to the cross member of the first pair of cross members in closest proximity to the foot rail, the third pair of cross members not only provides the structural support required for the retainer bar assembly, but further provides increased support and stability to the exemplary adjustable bed foundation.

Further features and advantages of the present invention will become evident to those of ordinary skill in the art after a study of the description, figures, and non-limiting examples in this document.

DESCRIPTION OF EXEMPLARY EMBODIMENTS

Figure 1:
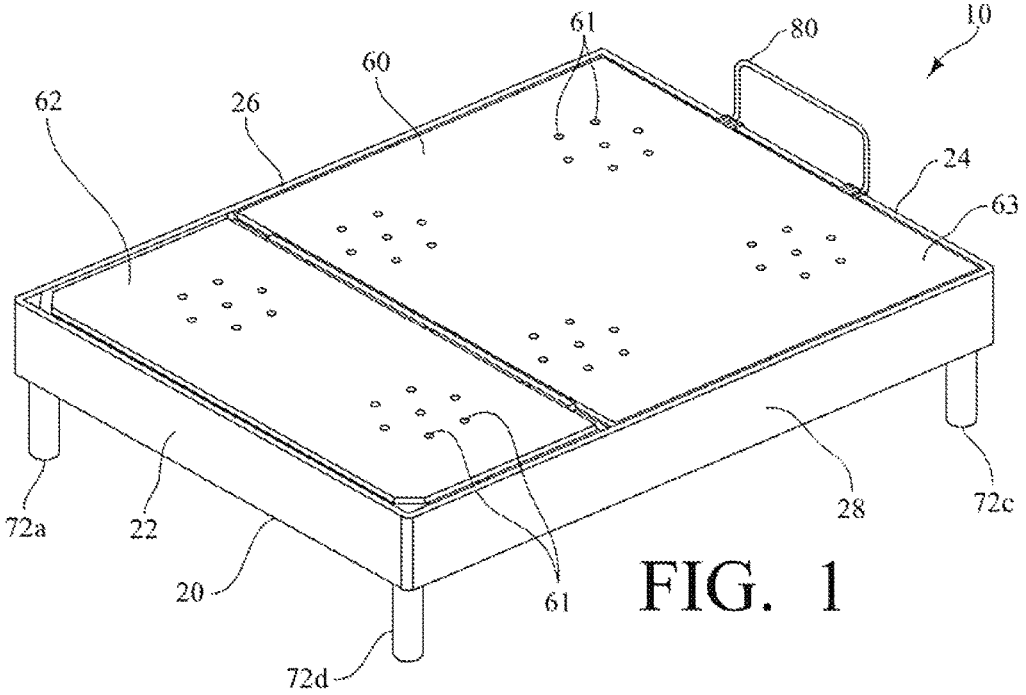
FIG. 1 is a perspective view of an exemplary adjustable bed foundation made in accordance with the present invention.
Figure 2:
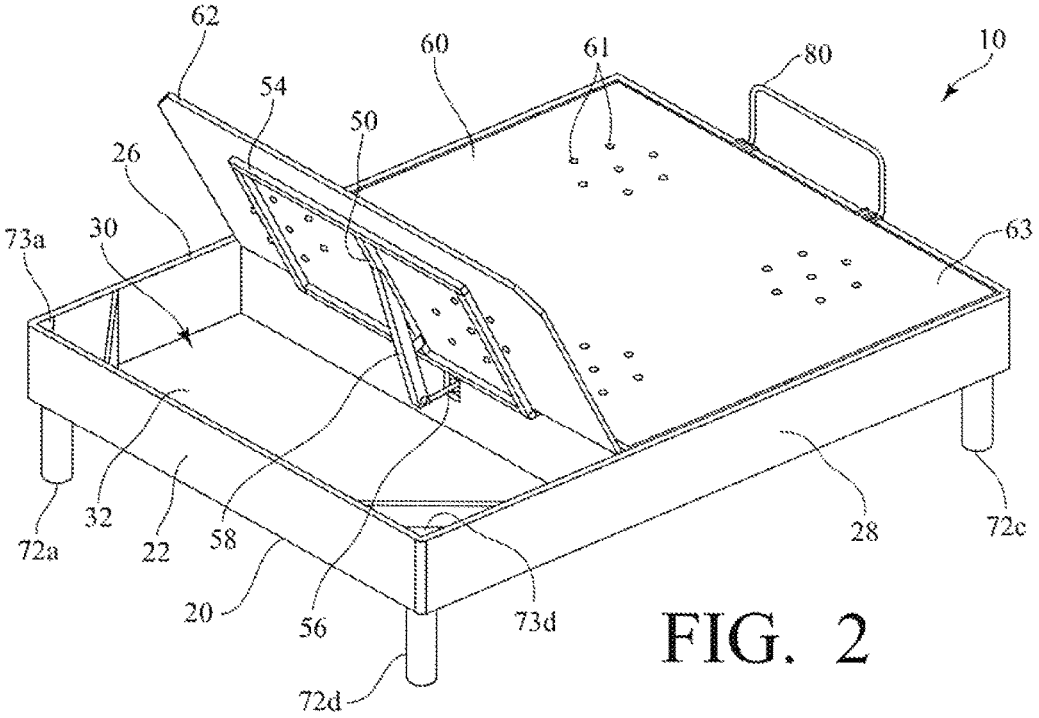
FIG. 2 is another perspective view of the adjustable bed foundation of FIG. 1, but showing a head section of the adjustable bed foundation upwardly rotated.

The present invention includes an adjustable bed foundation. In particular, the present invention includes an adjustable bed foundation that makes use of an articulating frame including a head section and stationary section, where the stationary section is secured to one or more cross members to reduce deflection of and damage to the adjustable bed foundation upon rotating the head section upward.

Referring first to FIGS. 1-3 and 5, in one exemplary embodiment of the present invention, an adjustable bed foundation 10 is provided that includes an outer support structure 20 having a head rail 22, a foot rail 24, a first side rail 26, and a second side rail 28. In the exemplary adjustable bed foundation 10, the foot rail 24 is spaced apart and parallel to the head rail 22. The first side rail 26 then extends from the head rail 22 to the foot rail 24, and the second side rail 28 extends from the head rail 22 to the foot rail 24 in a direction parallel to the first side rail 26, such that, upon the joining together of the rails 22, 24, 26, 28, the head rail 22, the foot rail 24, the first side rail 26, and the second side rail 28 collectively define both a perimeter and an interior cavity 30 of the outer support structure 20. Four legs 72*a*, 72*b*, 72*c*, 72*d* are then, optionally, positioned below and secured to the outer support structure 20 adjacent to the corner brackets 73*a*, 73*b*, 73*c*, 73*d* to support and raise the outer support structure 20 and, consequently, the reminder of the adjustable bed foundation 10 described herein below.

Further included in the exemplary adjustable bed foundation 10 is a first pair of cross members 40, 41 that each extend perpendicularly from the first side rail 26 to the second side rail 28 across the interior cavity 30 of the outer support structure 20. Each one of the first pair of cross members 40, 41 is spaced apart from the other cross member, such that the first pair of cross members 40, 41 divides the interior cavity 30 into three separate cavities, namely an upper cavity 32, a central cavity 34, and a lower cavity 36.

Also included in the adjustable bed foundation 10 is a second pair of cross members 42, 43 that extend perpendicularly between the first pair of cross members 40, 41 and across the central cavity 34 defined by the first pair of cross members 40, 41 and the portions of the first side rail 26 and the second side rail 28 felling between the first pair of cross members 40, 41. Similar to the first pair of cross members 40, 41, each one of the second pair of cross members 42, 43 are spaced apart from the other one of the second pair of cross members 42, 43. However, each one of the second, pair of cross members 42, 43 is also spaced apart from and in a direction parallel to the first side rail 26 and the second side rail 28 of the outer support structure 20 to thereby define an internal support area 38 within the central cavity 34.

Referring still to FIGS. 1-3 and 5, the head rail 22, the foot rail 24, the first side rail 26, and the second side rail 28 of the outer support structure 20, as well as the first pair of cross members 40, 41 and the second pair of cross members 42, 43 are generally comprised of a material having a hardness and rigidity sufficient to support a mattress and any users positioned on the mattress as the exemplary adjustable bed foundation 10 is articulated, but that also is capable of being readily joined together, such that the head rail 22, the fool rail 24, the first side rail 26, and the second side rail 28 of the outer support structure 20, as well as the first pair of cross members 40, 41 and the second pair of cross members 42, 43 can readily be attached to one another and assembled. Such materials include, but are not limited to, wood-based materials, such as oriented strand board (OSB), medium density fiberboard (MDF), high density fiberboard (HDF), and the like. For example, in the exemplary adjustable bed foundation 10 shown in FIGS. 1-3 and 5, the head rail 22, the foot rail 24, the first side rail 26, and the second side rail 28 of the outer support structure 20 are each made of MDF that can be sufficiently joined together using wood screws and wood glue and then further fastened together using four corner brackets 73*a*, 73*b*, 73*c*, 73*d*, as perhaps best shown in FIG. 5, to create a unitary outer support structure 20. In this regard, the first pair of cross members 40, 41 and the second pair of cross members 42, 43, which are also comprised of MDF in the exemplary bed foundation 10, can then be sufficiently secured to one another or to the first side rail 26 and the second side rail 28 by using wood glue and screws. Of course, it is contemplated that, numerous other types of materials and means for fastening various materials together to produce a sufficiently hard and rigid outer support structure and cross members of an exemplary adjustable bed foundation can also be used without departing from the spirit and scope of the present invention.

Figure 3:
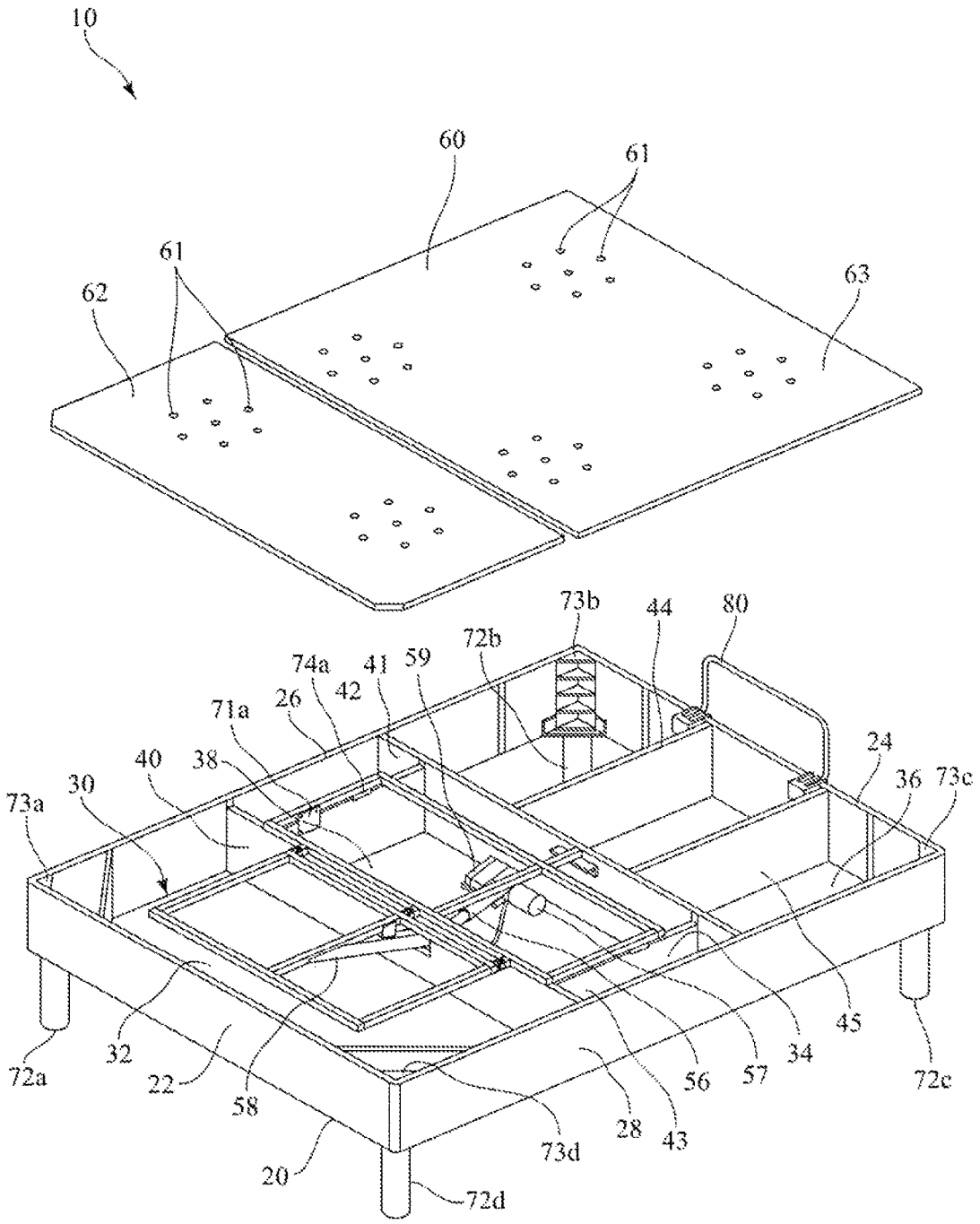
FIG. 3 is an exploded perspective view of the adjustable bed foundation of FIG. 1, and showing the platform removed from the adjustable bed foundation.
Figure 4:
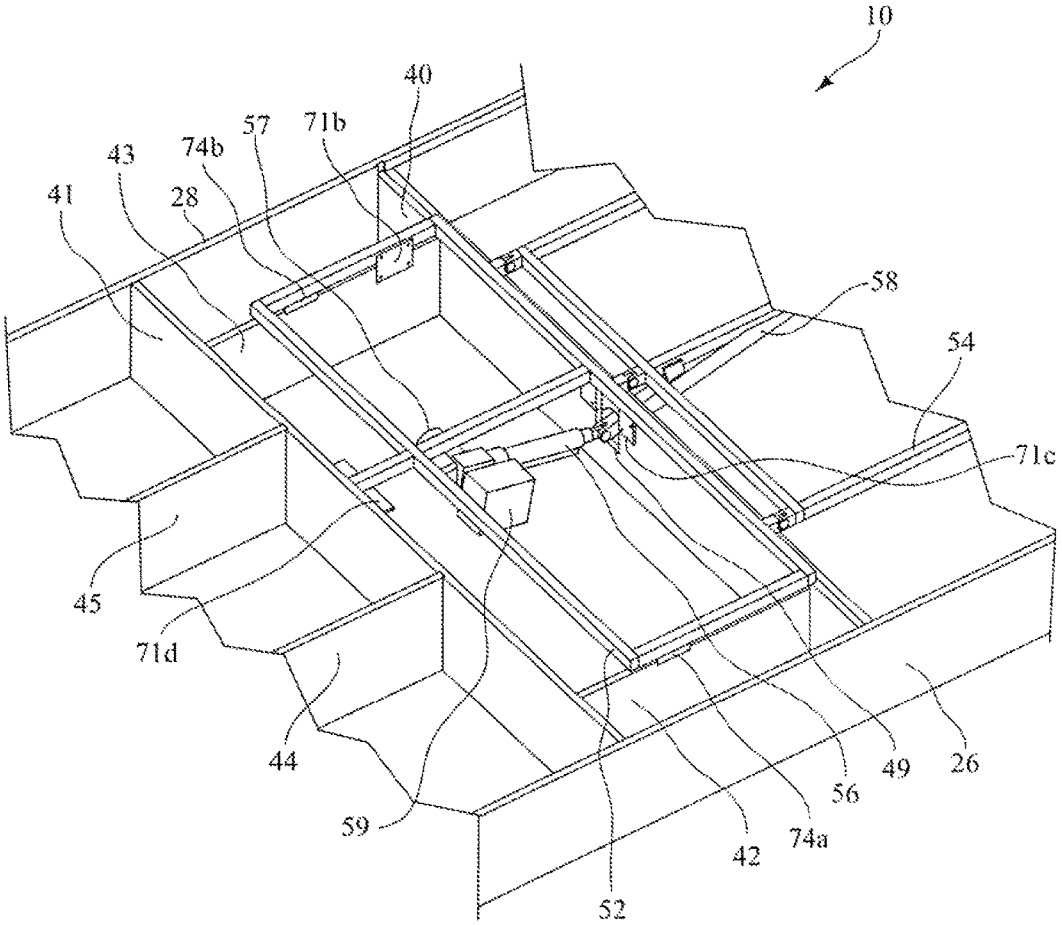
FIG. 4 is a partial perspective view of the adjustable bed foundation of FIG. 1, and showing the actuator assembly of the adjustable bed foundation.
Figure 5:
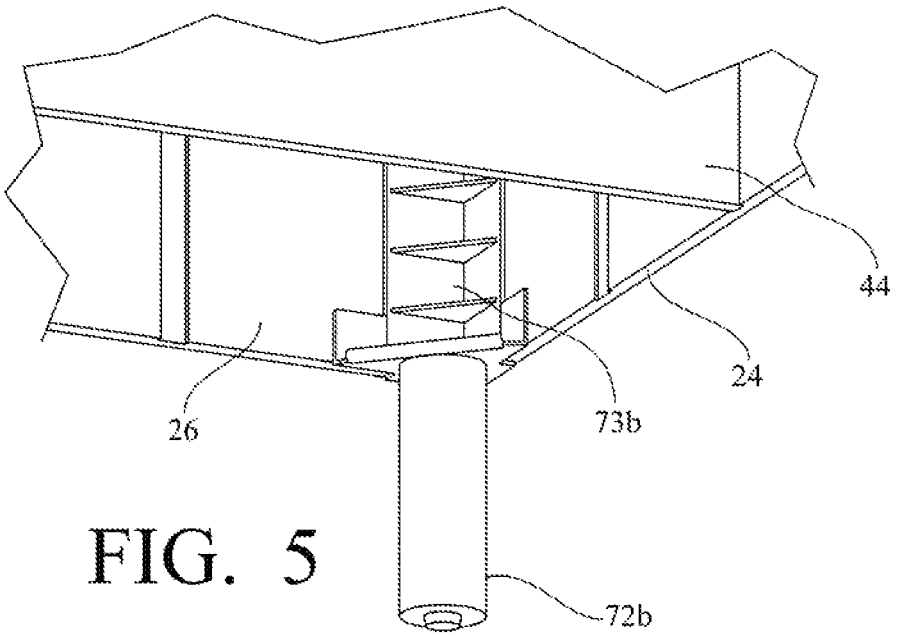
FIG. 5 is another partial perspective view of the adjustable bed foundation of FIG. 1, and showing a leg positioned beneath and secured to the outer support structure of the adjustable bed foundation.
Figure 6:
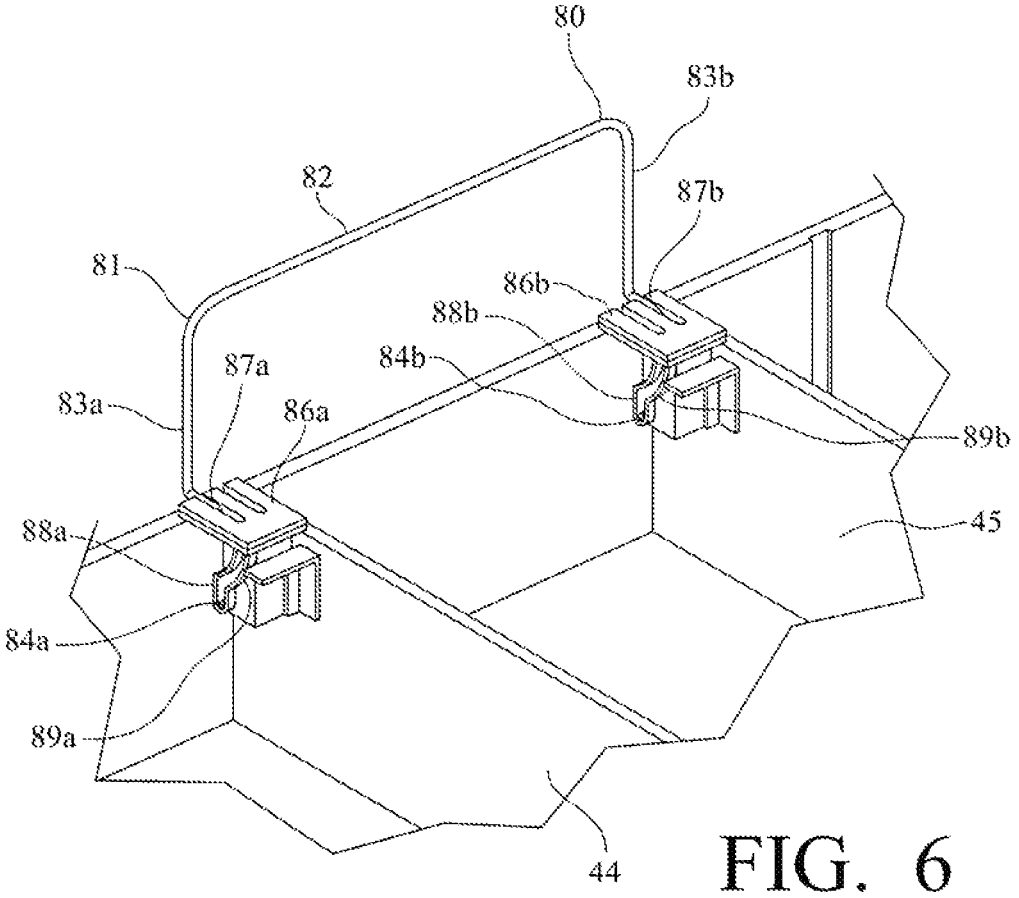
FIG. 6 is another partial perspective view of the adjustable bed foundation of FIG. 1, and showing a retainer bar assembly positioned adjacent to the foot rail of the outer support structure of the adjustable bed foundation.

Referring now to FIGS. 3 and 4, the adjustable bed foundation 10 also includes an articulating frame 50 that is preferably made from metal, such as tubular steel sections having an 11 gauge thickness and that can be welded together. The articulating frame 50 includes two sections, namely a stationary section 52 and a head section 54 that is pivotally connected to the stationary section 52. The head section 54 of the articulating frame 50 extends from the stationary section 52 and is housed within the upper cavity 32 of the adjustable bed foundation, 10, while the stationary section 52 is positioned atop the second pair of cross members 42, 43 and the cross member 40 of the first pair of cross members 40, 41 that is in closest proximity to the head rail 22. In this regard, each of the second pair of cross members 42, 43 and the cross member 40 of the first pair of cross members 40, 41 that is in closest proximity to the head rail 22 each generally have a height that is less than the height of the head rail 22, the foot rail 24, the first side rail 26, and the second side rail 28 such that the articulating frame 50 is flush with the topmost surface of the outer support structure 20 upon being attached to the outer support structure 20.

To attach the articulating frame 50 to the adjustable bed foundation 10, the articulating frame 50 is secured to each one of the second pair of cross members 42, 43 and to each one of the first pair of cross members 40, 41 by gap brackets 71*a*, 71*b*, 71*c*, 71*d* that are secured, to the stationary section 52 of the articulating frame 50 by horizontally-driven screws. By attaching the articulating frame 50 to at least the second pair of cross members 42, 43 in such a manner, the deflection and bowing that typically occurs in many of the currently-available adjustable bed foundations is not only eliminated, but the articulating frame 50 itself is also reduced in size as compared to articulating frames in other currently-available adjustable bed foundations. The reduced size of the articulating frame 50 then, in turn, provides for a stiffer frame structure and also leads to a reduction in deflection of the articulating frame 50 itself upon articulating the adjustable bed foundation 10. Furthermore, by making use of gap brackets 71*a*, 71*b*, 71*c*, 71*d* and horizontal screws to secure the stationary section 52 of the articulating frame 50 to each one of the second pair of cross members 42, 43 and to the each one of the first pair of cross members 40, 41, the articulated frame 50 is prevented from moving horizontally relative to the outer support structure 20 and there is also a reduction in the amount of noise generated upon rotating the head section 54 of the articulating frame 50 upwardly. To even further reduce the amount of noise generated upon rotating the head section 54 of the articulating frame 50 upwardly, the adjustable bed foundation 10 also includes a plurality of cushioning foam inserts or pads 74*a*, 74*b* that are positioned at least between the stationary section 52 of the articulating frame 50 and each of the second pair of cross members 42, 43, as shown best in FIG. 4.

Referring still to FIGS. 3 and 4, to upwardly rotate the head section 54 of the articulating frame 50 and articulate the adjustable bed foundation 10, the adjustable bed foundation 10 further includes an actuator assembly 56 that is operably connected to the articulating frame 50. The actuator assembly 56 comprises a motor 57 that is secured to the stationary section 52 of the articulating frame 50, and a reciprocating arm that is operably connected to both the motor 57 and to the head section 54 of the articulating frame 50. In this regard, in operation and upon activation of the motor 57 via a controller 59 that is operably connected to the actuator assembly 56 and that receives a user input (e.g., either directly or via a remote control), the motor 57 causes the reciprocating arm 58 to move backward or forward through an aperture 49 defined by the cross member 40 of the first pair of cross members 40, 41 in closest proximity to the head rail 22 and, consequently, raise or lower the head section 54 of the articulating frame 50.

Referring again to FIGS. 1 and 2, to allow the adjustable bed foundation 10 to adequately support a mattress, the adjustable bed foundation 10 further includes a platform 60 that is also made out of a wood-based or other sufficiently hard and rigid material, such as a plastic. The platform 60 generally includes a top portion 62 that is secured to the rotating head section 54 of the articulating frame 50 and that is positioned over the upper cavity 32, and a bottom portion 63 that is positioned over the central cavity 34 and the lower cavity 36. The platform 60 also defines one or more vent holes 61 that are spaced across the platform 60 and that extend through the platform 60 to provide ventilation to any mattress lying atop the platform 60 on the adjustable bed foundation 10.

With further regard to the adjustable bed foundation 10 of the present invention, the adjustable bed foundation 10 also includes one or more additional features to increase the performance and/or the functionality of the adjustable bed foundation. For instance, and referring now to FIGS. 1-3 and 6, to secure a mattress on the adjustable bed foundation 10 upon articulation, a retainer bar assembly 80 is included in the adjustable bed foundation 10 and is positioned adjacent to the foot rail 24 as in typical adjustable bed foundations. Unlike the retainer bars found in typical adjustable bed foundations, however, a portion of the retainer bar assembly 80 included in the exemplary adjustable bed foundation 10 of the present invention is configured to be moved upward and rotated away from an adjustable bed foundation 10, such that a mattress lying on the adjustable bed foundation 10 can then be easily manipulated. (e.g., to change the sheets covering the mattress). In particular, the retainer bar assembly 80 included in the exemplary adjustable bed foundation 10 includes a retainer bar 81 having a horizontal rod 82 and two legs 83*a*, 83*b* connected to the horizontal rod 82, with each of the two legs 83*a*, 83*b* having an end portion 84*a*, 84*h* that extends from the legs 83*a*, 83*b* in a direction substantially parallel to the horizontal, rod 82.

To secure the retainer bar 81 to the adjustable bed foundation 10, the retainer bar assembly 80 further includes a pair of brackets 86*a*, 86*b* that each generally define at least one channel 87*a*, 87*b* configured to receive an end portion 84*a*, 84*b* of one of the two legs 83*a*, 83*b*. Unlike the rigidly-attached retainer bar assemblies typically used with adjustable foundations, however, each channel 87*a*, 87*b* of the brackets 86*a*, 86*b* of the retainer bar assembly 80 includes a vertical segment 88*a*, 88*b* and an angled segment 89*a*, 89*b*, such that each of the channels 87*a*, 87*b* is configured to allow the horizontal rod 82 to be moved (e.g., pulled) upward and then rotated away from each bracket 86*a*, 86*b*. For further information and guidance related to a retainer bar assembly configured to be rotated away from a bed foundation, see, e.g., International Patent Application No. PCT/US2013/053729, filed Aug. 6, 2013, and which is incorporated herein by reference in its entirety, To attach the retainer bar assembly to the exemplary adjustable bed foundation 10 of the present invention, the adjustable bed foundation 10 also includes a third pair of cross members 44, 45 that are spaced apart from one another and that extend perpendicularly from the foot rail 24 to the cross member 41 of the first pair of cross members 40, 41 that is in closest proximity to the foot rail 24. By extending the third pair of cross members 44, 45 from the foot rail 24 to the cross member 41 of the first pair of cross members 40, 41 in closest proximity to the foot rail 24, the third pair of cross members 44, 45 not only provides the structural support required for the retainer bar assembly 80, but further provides increased support and stability to the exemplary adjustable bed foundation 10.

One of ordinary skill in the art will recognize that additional embodiments or implementations are possible without departing front the teachings of the present invention or the scope of the claims which follow. This detailed description, and particularly the specific details of the exemplary embodiments and implementations disclosed herein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. An adjustable bed foundation, comprising:

an outer support structure including a head rail, a foot rail spaced apart and parallel to the head rail, a first side rail extending from the head rail to the foot rail, and a second side rail extending from the head rail to the foot rail in a direction parallel to the first side rail, such that the head rail, the foot rail, the first side rail, and the second side rail collectively define a perimeter and an interior cavity of the outer support structure;

a first pair of cross members extending perpendicularly from the first side rail to the second side rail, each one of the first pair of cross members spaced apart from the other cross member to divide the interior cavity into an upper cavity, a central cavity, and a lower cavity;

a second pair of cross members extending perpendicularly between the first pair of cross members in the central cavity, each one of the second pair of cross members spaced apart from the other cross member and from the first side rail or the second side rail of the outer support structure; and an articulating frame including a stationary section and a head section pivotally connected to the stationary section, the stationary section secured to the second pair of cross members, wherein the articulating frame is flush with the top most surface of the outer support structure.

2. The adjustable bed foundation of claim 1, further comprising a platform positioned over the interior cavity of the outer support structure.

3. The adjustable bed foundation of claim 2, wherein the platform defines one or more vent holes extending through the platform.

4. The adjustable bed foundation of claim 2, wherein the platform includes a top portion and a bottom portion, the top portion of the platform secured to the head section of the articulating frame and positioned over the upper cavity, and the bottom portion of the platform positioned over the central cavity and the lower cavity.

5. The adjustable bed foundation of claim 1, further comprising an actuator assembly operably connected to the articulating frame, the actuator assembly for upwardly rotating the head section.

6. The adjustable bed foundation of claim 5, wherein the actuator assembly comprises a motor secured to the stationary section of the articulating frame and a reciprocating arm operably connected to the motor and to the head section of the articulating frame.

7. The adjustable bed foundation of claim 5, further comprising a controller for controlling the actuator assembly.

8. The adjustable bed foundation of claim 1, further comprising one or more gap brackets for attaching the stationary section of the articulating frame to the second pair of cross members.

9. The adjustable bed foundation of claim 1, further comprising one or more legs positioned below and secured to the outer support structure.

10. The adjustable bed foundation of claim 1, further comprising one or more corner brackets for securing the head rail and the foot rail to the first side rail and the second side rail.

11. The adjustable bed foundation of claim 1, further comprising a retainer bar assembly positioned adjacent to the foot rail and configured to secure a mattress on the adjustable bed foundation.

12. The adjustable bed foundation of claim 11, wherein the retainer bar assembly comprises:

a retainer bar having a horizontal rod and two legs connected to the horizontal rod, each of the two legs having an end portion extending therefrom in a direction substantially parallel to the horizontal rod; and a pair of brackets, each bracket defining at least one channel for receiving the end portion of each of the two legs, and each channel having a vertical segment and an angled segment such that each channel is configured to allow the horizontal rod to be moved upward and rotated away from each bracket.

13. The adjustable bed foundation of claim 1, further comprising a third pair of cross members extending perpendicularly from the foot rail to the one of the first pair of cross members in closest proximity to the foot rail.

14. The adjustable bed foundation of claim 1, further comprising one or more cushioning pads positioned between the articulating frame and the first pair of cross members, the second pair of cross members, or both.

15. An adjustable foundation, comprising:

an outer support structure including a head rail, a foot rail, and two parallel side rails;

a first pair of cross members extending perpendicularly between the two parallel side rails, each one of the first pair of cross members spaced apart from the other cross member and fixed relative to the parallel side rails;

a second pair of cross members extending perpendicularly between the first pair of cross members, each one of the second pair of cross members spaced apart from the other cross member and from the parallel side rails;

an articulating frame including a stationary section and a head section pivotally connected to the stationary section, the stationary section secured to the second pair of cross members, and the head section extending towards the head rail, wherein the articulating frame is flush with the top most surface of the outer support structure; and a platform including a top portion and a bottom portion, the top portion of the platform secured to the head section of the articulating frame and the bottom portion of the platform positioned over the stationary section of the articulating frame.

16. The adjustable foundation of claim 15, further comprising a retainer bar assembly positioned adjacent to the foot rail and configured to secure a mattress on the adjustable foundation.

17. An adjustable bed assembly, comprising:

an outer support structure including a head rail, a foot rail, and two parallel outermost side rails;

a first pair of cross members extending perpendicularly between the outermost parallel side rails, each one of the first pair of cross members spaced apart from the other cross member;

a second pair of cross members extending perpendicularly between the first pair of cross members, each one of the second pair of cross members spaced apart from the other cross member and from the outermost parallel side rails;

an articulating frame including a stationary section and a head section pivotally connected to the stationary section, the stationary section secured to the second pair of cross members, and the head section extending towards the head rail, the stationary section of the articulating frame being flush with a top surface of the outer support structure;

a platform including a top portion and a bottom portion, the top portion of the platform secured to the head section of the articulating frame and the bottom portion of the platform positioned over the stationary section of the articulating frame; and a mattress positioned atop the platform.

18. The adjustable bed assembly of claim 17, further comprising a retainer bar assembly positioned adjacent to the foot rail and configured to secure the mattress on the platform.

* * * * *